US006203971B1

(12) United States Patent
Ohzeki

(10) Patent No.: US 6,203,971 B1
(45) Date of Patent: Mar. 20, 2001

(54) PHOTOGRAPHIC SILVER HALIDE EMULSION, PHOTOGRAPHIC LIGHT-SENSITIVE MATERIAL USING SAME EMULSION, AND METHOD OF PROCESSING SAME LIGHT-SENSITIVE MATERIAL

(75) Inventor: Katsuhisa Ohzeki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/407,968

(22) Filed: Sep. 29, 1999

(30) Foreign Application Priority Data

Sep. 30, 1998 (JP) ..... 10-278255
May 25, 1999 (JP) ..... 11-145224

(51) Int. Cl.[7] ..... G03C 1/035

(52) U.S. Cl. ..... 430/567; 430/569

(58) Field of Search ..... 430/567, 569

(56) References Cited

U.S. PATENT DOCUMENTS

| | | | | |
|---|---|---|---|---|
| 5,183,732 | | 2/1993 | Maskasky | 430/569 |
| 5,217,858 | | 6/1993 | Maskasky | 430/567 |
| 5,618,656 | * | 4/1997 | Szajewski et al. | 430/393 |
| 5,667,949 | * | 9/1997 | Szajewski | 430/489 |
| 6,048,682 | * | 4/2000 | Ohzeki et al. | 430/567 |

* cited by examiner

*Primary Examiner*—Hoa Van Le
(74) *Attorney, Agent, or Firm*—Sughrue, Mion, Zinn, Macpeak & Seas, PLLC

(57) ABSTRACT

A photographic silver halide emulsion is disclosed, comprising tabular grains: the tabular grains having a silver chloride content of at least 95 mole %, an aspect ratio of at least 2 and a distance between the main planes of 0.13 $\mu$m or less; wherein the tabular grains occupy at least 90%, based on total projected area, of the total silver halide grains in the emulsion and have a variation coefficient of 20% or less in the distance between the main planes; and a silver halide photographic material comprising a support having thereon the silver halide emulsion and a method of development-processing the silver halide photographic material are disclosed.

13 Claims, 1 Drawing Sheet

PHOTOGRAPHIC SILVER HALIDE EMULSION, PHOTOGRAPHIC LIGHT-SENSITIVE MATERIAL USING SAME EMULSION, AND METHOD OF PROCESSING SAME LIGHT-SENSITIVE MATERIAL

FIELD OF THE INVENTION

The present invention relates to a photographic silver halide emulsion, a photographic light-sensitive material using such an emulsion and a method of development-processing such a light-sensitive material. In particular, this invention is concerned with a photographic tabular silver halide grain emulsion comprising silver chloride grains or silver chlorobromide, chloroiodide or chloroiodobromide grains having a high chloride content.

BACKGROUND OF THE INVENTION

Hitherto, various techniques for utilizing silver halide grains with a high silver chloride content (specifically, the silver halide grains having a chloride content of at least 95 mole %, which are referred to as the high-silver chloride grains hereinafter) have been proposed with the intention of making the photographic processing simple and rapid. Utilizing high-silver chloride grains has advantages of enhancing the reusability of processing solutions as well as increasing the development speed. Therefore, the photosensitive materials comprising high-silver chloride grains occupy the mainstream of photosensitive materials for printing, such as color photographic printing paper. In the present invention, processing time means the time from the initiation of processing (contact of a photographic material with a developing solution) to drying (Dry to Dry).

The high-silver chloride grains formed under ordinary conditions are grains having (100) faces as their external surfaces (referred to as {100} grains hereinafter). The grains put into practical use were also cubic grains. In recent years, tabular {100} grains have been developed since they have advantages of enabling effective spectral sensitization and ensuring a great covering power after development due to their large specific surface area (high ratio of the surface areas to the volume of each grain). Examples of such tabular grains are disclosed in U.S. Pat. Nos. 5,320,938, 5,264,337 and 5,292,632. Having high spectral sensitization efficiency is important particularly for high-silver chloride grains in which absorption of light in the blue-sensitive region is slight as compared with silver from iodide grains.

However, the high-silver chloride {100} grains have a problem of being easily fogged, as compared with commonly used silver bromide grains. In order to overcome this problem, high-silver chloride grains having (111) faces as their external surfaces (referred to as {111} grains) are utilized. Examples of these grains are disclosed in JP-A-6-138619 (the term "JP-A" as used herein means an "unexamined published Japanese patent application").

The formation of high-silver chloride {111} grains requires special contrivances. For instance, the method of forming high-silver chloride tabular grains in the presence of ammonia is disclosed by Wey in U.S. Pat. No. 4,399,215. The use of ammonia makes it difficult to form practically useful fine grains because silver chloride grains originally having high solubility is produced with a higher solubility condition. In addition, the pH at the time of manufacturing grain is raised to 8–10 by the use of ammonia; as a result, the grains are easily fogged. On the other hand, the high-silver chloride {111} grains formed in the presence of thiocyanates are disclosed by Maskasky in U.S. Pat. No. 5,061,617. Similarly to ammonia, the thiocyanates increase the solubility of silver chloride.

Further, there are known the methods of using the following additives [crystal phase controlling agents (which is sometimes called crystal habit control agents)] at the time of grain formation for the purpose of forming high-chloride grains the surfaces of which are constituted of (111) faces:

| Document | Crystal habit control agent | Inventor |
|---|---|---|
| U.S. Pat. No. 4,400,463 | Azaindenes + Thioether peptizer | Maskasky |
| U.S. Pat. No. 4,783,398 | 2,4-Dithiazolidinone | Mifune et al. |
| U.S. Pat. No. 4,713,323 | Aminopyrazolopyrimidine | Maskasky |
| U.S. Pat. No. 4,983,508 | Bispyrimidinium salts | Ishiguro et al. |
| U.S. Pat. No. 5,185,239 | Triaminopyridine | Maskasky |
| U.S. Pat. No. 5,178,997 | 7-Azaindole compounds | Maskasky |
| U.S. Pat. No. 5,178,998 | Xanthine | Maskasky |
| JP-A-64-70741 | Dyes | Nishikawa et al. |
| JP-A-3-212639 | Aminothioether | Ishiguro |
| JP-A-4-283742 | Thiourea derivatives | Ishiguro |
| JP-A-4-335632 | Triazolium salts | Ishiguro |
| JP-A-2-32 | Bispyridinium salts | Ishiguro et al. |
| JP-A-8-227117 | Monopyridinium salts | Ozeki et al. |

The grains obtained using those methods have comparatively large sizes, specifically an average equivalent circle diameter of about 1 $\mu$m (the term "average equivalent circle diameter" used herein means the average value of diameters of circles having the same areas as the projected areas of grains). From a practical point of view, however, it has so far been desired to form silver halide grains having a thin tabular shape, a high silver chloride content and grain sizes smaller than those achievable by the methods described above. In particular, thin tabular grains have been desired because they have a large specific surface area. Examples of thin high-silver chloride {111} tabular grains are disclosed in U.S. Pat. Nos. 5,217,858 and 5,183,732. However, a decrease in thickness of tabular grains causes a problem that the grains are easily dissolved during the photographic processing. In the practical color development-processing, the photosensitive materials are passed through a developer, a bleach-fixing solution and a washing solution in this order. Therefore, there is great danger of contaminating a developer with a fix-bleaching solution. As a result of the contamination, dissolution physical development impairs the photographic properties (sensitizing and increasing contrast). These phenomena are also promoted by decrease in grain size.

When the grain thickness distribution or/and the grain size distribution are broad (polydispersed), the grains in a thin grain section or a small size section of the distribution are especially subject to dissolution, and so they have low stability in processing solutions. In the documents described above, the tabular grains having an average equivalent circle diameter of 0.8 $\mu$m or less are disclosed, but the proportion of such tabular grains to the total grains is 85%, on a projected area basis. In the case of containing iodide in tabular grains, the proportion of the tabular grains to the total grains is 70%. When the grains having different grain shapes are intermingled, they lack the uniformity in adsorption of sensitizing dyes thereto and the chemical sensitization thereof to result in deterioration of photographic characteristics.

SUMMARY OF THE INVENTION

Therefore, an object of the present invention is to provide a photographic silver halide emulsion comprising tabular high-silver chloride grains which has a high sensitivity, hardly causes fog and ensures high development-processing stability; a photographic light-sensitive material comprising such an emulsion, and a method of development-processing such a light-sensitive material.

The object is attained with the following embodiments according to the present invention:

1. A photographic silver halide emulsion comprising tabular grains: the tabular grains having a silver chloride content of at least 95 mole %, an aspect ratio of at least 2 and a distance between main planes of 0.13 μm or less; wherein the tabular grains occupy at least 90%, based on the total projected area, of the total silver halide grains in the emulsion and have a variation coefficient of 20% or less in the distance between the main planes.

Further, preferred embodiments are shown below.

2. The silver halide emulsion as described in the above item 1, wherein the tabular grains have an average equivalent circle diameter of 0.8 μm or less.

3. The silver halide emulsion as described in the above item 1, wherein the tabular grains have a variation coefficient of 22% or less in the equivalent circle diameter.

4. The silver halide emulsion as described in the above item 1, wherein the tabular grains comprise tabular grains having (111) faces as the main plane.

5. The silver halide emulsion as described in the above item 1, wherein the tabular grains have a silver iodide content of from 0.2 to 0.6 mole % based on the silver.

6. The silver halide emulsion as described in the above item 1, wherein said tabular grains have a silver bromide content of from 0.1 to 4 mole % based on the silver.

7. The silver halide emulsion as described in the above item 1, wherein the tabular grains each comprise a core and a shell as the outermost layer and the silver iodide content in the shell is at least 2 mole %.

8. The silver halide emulsion as described in the above item 1, wherein the tabular grains each contain a bromide-localized phase in which the difference between the bromide-localized phase and other phases in bromide concentration is at least 6 mole %.

9. The silver halide emulsion as described in the above item 8, wherein the bromide-localized phase contains an iridium compound in a proportion of from $1\times10^{-8}$ to $1\times10^{-5}$ mole % based on the total silver in each grain.

10. A silver halide photographic material comprising a support having thereon at least two light-sensitive layers, wherein the light-sensitive layer arranged farthest from the support comprises a silver halide emulsion comprising tabular grains:

the tabular grains having a silver chloride content of at least 95 mole %, an aspect ratio of at least 2 and a distance between main planes of 0.13 μm or less; wherein the tabular grains occupy at least 90%, based on the total projected area, of the total silver halide grains in the emulsion and have a variation coefficient of 20% or less in the distance between the main planes.

11. A silver halide photographic material comprising a support having thereon at least one silver halide emulsion layer, wherein at least one of the emulsion layers comprises a silver halide emulsion comprising tabular grains:

the tabular grains having a silver chloride content of at least 95 mole %, an aspect ratio of at least 2 and a distance between main planes of 0.13 μm or less; wherein the tabular grains occupy at least 90%, based on the total projected area, of the total silver halide grains in the emulsion and have a variation coefficient of 20% or less in the distance between the main planes.

12. A method of development-processing a silver halide photographic material, wherein the photographic material processed is a silver halide photographic material comprising a support having thereon at least two light-sensitive layers, wherein the light-sensitive layer arranged farthest from the support comprises a silver halide emulsion comprising tabular grains:

the tabular grains having a silver chloride content of at least 95 mole %, an aspect ratio of at least 2 and a distance between main planes of 0.13 μm or less; wherein the tabular grains occupy at least 90%, based on the total projected area, of the total silver halide grains in the emulsion and have a variation coefficient of 20% or less in the distance between the main planes, and the dry-to-dry processing time is 60 sec or less.

13. A method of development-processing a silver halide photographic material, wherein the photographic material processed is a silver halide photographic material comprising a support having thereon at least one silver halide emulsion layer, wherein at least one of the emulsion layers comprises a silver halide emulsion comprising tabular grains:

the tabular grains having a silver chloride content of at least 95 mole %, an aspect ratio of at least 2 and a distance between main planes of 0.13 μm or less; wherein the tabular grains occupy at least 90%, based on the total projected area, of the total silver halide grains in the emulsion and have a variation coefficient of 20% or less in the distance between the main planes, and the dry-to-dry processing time is 60 sec. or less.

DETAILED DESCRIPTION OF THE INVENTION

Figure 1:
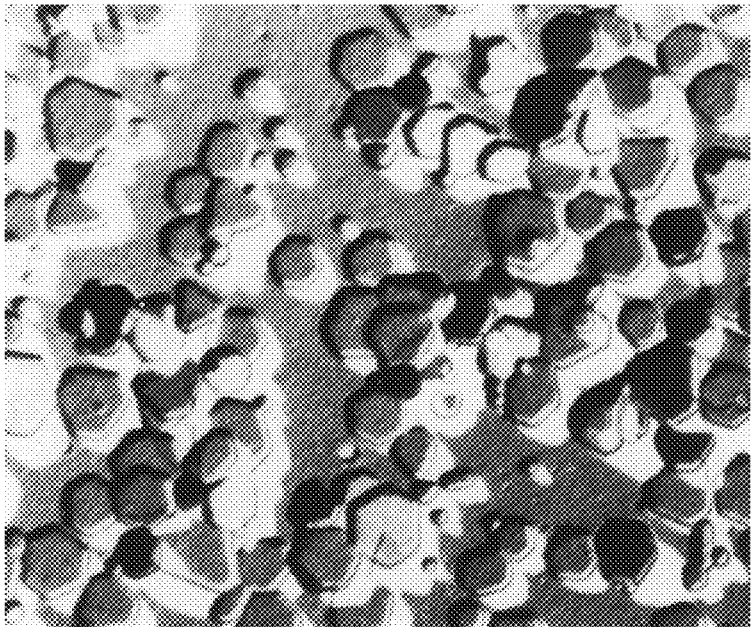
FIG. 1 is an electron microscope photograph showing the crystal structure of silver halide grains after 16 minutes' ripening in Example 8. The magnification thereof was 24,000. The black spots in the electron microscope photograph are latex balls having a diameter of 0.22 μm.

The methods for forming tabular grains are described below. First, the method of forming {111} tabular grains is illustrated. The {111} tabular grains of the present invention are basically formed by three steps of nucleation, ripening and growth. In a case of forming superfine grains, the growth process may be omitted.

<Nucleation>

The tabular grains are obtained by forming two parallel twin planes. The formation of twin planes depends chiefly on the temperature, the dispersing medium (gelatin) concentration and the halide concentration. Therefore, it is necessary to impose appropriate conditions on those factors. When the nucleation is carried out in the presence of a crystal habit control agent, the suitable gelatin concentration is from 0.1 to 10%.

On the other hand, JP-A-8-184931 discloses that the nucleation in the absence of a crystal habit control agent is desirable for the formation of monodisperse grains. When the nucleation is carried out using no crystal habit control agent, the suitable gelatin concentration is from 0.03 to 10%, preferably from 0.05 to 1.0%. The chloride concentration is from 0.001 to 1 mole/l, preferably from 0.003 to 0.1 mole/l. The nucleation temperature, though can be chosen arbitrarily from the range of 2 to 60° C., is desirably from 5° C. to 45° C., particularly preferably from 5° C. to 35° C.

The gelatin suitable for nucleation is gelatin having a high molecular weight of at least $1.0\times10^5$.

For the formation of tabular nuclei, it is desirable that the pCl be from 1.2 to 2.3. In particular, the pCl range of 1.2 to 1.8 is adequate to make the thickness monodisperse.

<Ripening>

Although the nuclei of tabular grains are formed in the first nucleation step, many nuclei other than the nuclei of tabular grains are also present in the reaction vessel just after nucleation. This situation requires the techniques of retaining tabular grains alone and making other grains disappear by ripening after nucleation. When usual Ostwald ripening is carried out, the tabular grain nuclei also dissolve and disappear, and thereby the number of the tabular grain nuclei is decreased; as a result, the tabular grains obtained increase in size. In order to prevent the increase in grain size, crystal habit control agents are added. In particular, the use of a crystal habit control agent in combination with phthalated, succinated, or trimellited gelatin is effective in making the grain thickness monodisperse as well as enhancing the effect of the crystal habit control agent and preventing the tabular grain nuclei from dissolving. In the combined use, the proportion of the crystal habit control agent to the phthalated, succinated or trimellited gelatin is an important factor. Specifically, it is desirable that the crystal habit control agent be used in an amount of $3\times10^{-6}$ to $6\times10^{-6}$ mole per gram of phthalated, succinated or trimellited gelatin. Therein, the crystal habit control agent and the gelatin solution may be added simultaneously or successively. Preferably, they are added as a previously mixed solution.

In the ripening, the pAg is particularly important, and it is preferable that the silver potential is from 60 to 130 mV against the saturated calomel electrode (SCE).

Efficient ripening can be achieved by carrying out the ripening at a temperature higher than the nucleation temperature. In particular, it is desirable that the ripening temperature be higher than the nucleation temperature by at least 15° C.

<Growth>

Cases are illustrated below where the nuclei formed are physically ripened and further made to grow in the presence of a crystal habit control agent by the addition of a silver salt and halides. Herein, the chloride concentration is controlled to 5 mole/l or less, preferably 0.05 to 1 mole/l. The temperature during the grain growth can be chosen from the range of 10 to 95° C., preferably 30 to 75° C.

It is desirable that the total amount of crystal habit control agent used be at least $6\times10^{-5}$ mole, especially from $3\times10^{-4}$ to $6\times10^{-2}$ mole, per mole of silver halide in the finished emulsion. The crystal habit control agent may be added at any time, from the nucleation to the physical ripening and during the grain growth of the silver halide grains. For instance, the crystal habit control agent may be previously added to a reaction vessel. In the case of forming small-size tabular grains, it is desirable to keep on adding the crystal habit control agent and increasing the concentration thereof with the progress of grain growth.

When the amount of dispersing medium used at the time of nucleation or grain growth is insufficient for the grain growth, it is required to make up for the shortage by further adding the dispersing medium. For the growth, it is desirable that the gelatin be present in an amount of 10 g/l to 100 g/l. The gelatin preferable for supplementation is phthalated gelatin or trimellited gelatin.

The pH during the grain formation, though it has no particular limitation, is desirably neutral or in an acidic region.

As mentioned above, many compounds are disclosed with respect to the crystal habit control agents used for forming {111} tabular silver chloride grains. For forming the {111} tabular grains of the present invention, the compounds represented by the following formulae (I), (II) and (III), especially formula (III), are preferred as crystal habit control agent:

(I)

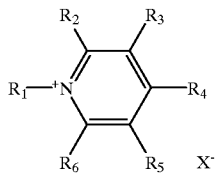

(II)

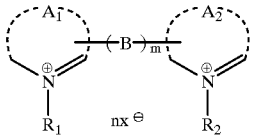

(III)

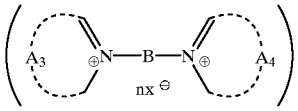

In Formula (I), $R_1$ is desirably a straight-chain, branched or cyclic alkyl group having 1 to 20 carbon atoms (e.g., methyl, ethyl, isopropyl, t-butyl, n-octyl, n-decyl, n-hexadecyl, cyclopropyl, cyclopentyl, cyclohexyl), an alkenyl group having 2 to 20 carbon atoms (e.g., allyl, 2-butenyl, 3-pentenyl), or an aralkyl group having 7 to 20 carbon atoms (e.g., benzyl, phenetyl). Each of these groups reposented by $R_1$ may have a substituent. Examples of such a substituent include the following substitutable groups represented by $R_2$ to $R_6$.

$R_2$, $R_3$, $R_4$, $R_5$ and $R_6$ may be the same as or different from one another. Each of them is a hydrogen atom or a substitutable group. Examples of such a substitutable group include a halogen atom, an alkyl group, an alkenyl group, an alkynyl group, an aralkyl group, an aryl group, a heterocyclic group (e.g., pyridyl, furyl, imidazolyl, piperidyl, morpholino), an alkoxy group, an aryloxy group, an amino group, an acylamino group, an ureido group, an urethane group, a sulfonylamino group, a sulfamoyl group, a carbamoyl group, a sulfonyl group, a sulfinyl group, an alkyloxycarbonyl group, an acyl group, an acyloxy group, a phosphoric acid amide group, an alkylthio group, an arylthio group, a cyano group, a sulfo group, a carboxyl group, a hydroxyl group, a phosphono group, a nitro group, a sulfino group, an ammonio group (e.g., trimethylammonio group), a phosphonio group and a hydradino group. Each of these groups may be further substituted.

$R_2$ and $R_3$, $R_3$ and $R_4$, $R_4$ and $R_5$, and $R_5$ and $R_6$, may be condensed to form a quinoline, isoquinoline or acridine ring.

$X^-$ represents a counter anion, with examples including a halogen ion (e.g., chlride ion, bromide ion), nitrate ion, sulfate ion, p-toluenesulfonate ion or trifluoromethanesulfonate ion.

In Formula (I), it is desirable that $R_1$ be an aralkyl group and at least one of the other substituents $R_2$ to $R_6$ be an aryl group.

Therein, it is more preferable that $R_1$ be an aralkyl group, $R_4$ be an aryl group and $X^-$ be a halogen ion. Examples of such compounds are disclosed as the Crystal Habit Control Agents 1 to 29 in EP-A-0723187. However, the invention should not be construed as being limited to these exemplified ones.

The compounds represented by Formulae (II) and (III) respectively are illustrated below.

$A_1$, $A_2$, $A_3$ and $A_4$ each represent a nonmetallic element necessary for completing a nitrogen-containing hetero ring, which may further contain an oxygen, nitrogen or sulfur atom in the ring or/and form a condensed ring by condensing together with a benzene ring. The hetero rings formed by $A_1$, $A_2$, $A_3$ and $A_4$ respectively may have substituent groups, which may be the same as or different from one another. Examples of substituent groups include an alkyl group, an aryl group, an aralkyl group, an alkenyl group, a halogen atom, an acyl group, an alkoxycarbonyl group, an aryloxycarbonyl group, a sulfo group, a carboxyl group, a hydroxyl group, an alkoxy group, an aryloxy group, an amido group, a sulfoamoyl group, a carbamoyl group, an ureido group, an amino group, a sulfonyl group, a cyano group, a nitro group, a mercapto group, an alkylthio group and an arylthio group. Suitable examples of $A_1$, $A_2$, $A_3$ and $A_4$ each include 5- and 6-membered rings (such as a pyridine ring, an imidazole ring, a thiazole ring, an oxazole ring, a pyrazine ring and a pyrimidine ring). Preferably, each ring is a pyridine ring.

B represents a divalent linking group. Herein, the divalent linking group is a linking group consisting of an alkylene group, an arylene group, an alkenylene group, —$SO_2$—, —SO—, —O—, —S—, —CO—, —N($R'_2$)— (wherein $R'_2$ is an alkyl group, an aryl group or a hydrogen atom) and alone or in combination. Preferably, B is an alkylene or alkenylene group.

m represent 0 or 1.

$R_1$ and $R_2$ each represent an alkyl group having 1 to 20 carbon atoms. $R_1$ and $R_2$ may be the same or different from each other.

Herein, the alkyl group means a substituted or unsubstituted alkyl group. The substituent groups for the alkyl group are the same as those exemplified as the substituent groups of $A_1$, $A_2$, $A_3$ or $A_4$.

Suitable examples of $R_1$ and $R_2$ each include an alkyl groups having 4 to 10 carbon atoms. Preferably, $R_1$ and $R_2$ are each an alkyl group substituted by a substituted or unsubstituted aryl group.

X represents an anion. Examples of such an anion include chloride ion, bromide ion, iodide ion, nitrate ion, sulfate ion, p-toluenesulfonate ion and oxalate ion. n represents 0 or 1, and it is 0 when the inner salt is formed.

Examples of the compounds represented by formulae (II) and (III) respectively include the Compounds (1) to (42) disclosed in U.S. Pat. No. 4,983,508 and the Compounds (1) to (32) disclosed in U.S. Pat. No. 5,432,052. However, the present invention should not be construed as being limited to those compounds.

In the next place, the {100} tabular grains are illustrated.

The {100} tabular grains are tabular grains having (100) faces as their main planes. As to the shape of the main planes, each main plane may be a right-angled parallelogram, a triangle or pentagon formed by lacking one corner of the right-angled parallelogram (the part lacked from the parallelogram has a shape of right triangle formed by the apex of the corner and the sides diverging from the apex), or a quadrangle to an octagon formed by lacking two to four corners of the right-angled parallelogram.

The lacked part is supplemented to form a right-angled parallelogram. Herein, this parallelogram is referred to as a supplemented quadrilateral. As to the lengths of adjacent sides in both right-angled parallelogram and supplemented quadrilateral, it is desirable that the ratio between them (the ratio between the long side length to the short side length) be from 1 to 6, preferably 1 to 4, more preferably 1 to 2.

The silver halide tabular emulsion grains having (100) main planes can be formed, e.g., as follows: The addition of aqueous solutions of silver salt and halide to a dispersing medium, such as an aqueous solution of gelatin, and the mixing thereof with stirring are carried out in the presence of silver iodide or iodide ion, or silver bromide or bromide ion, as disclosed in JP-A-6-301129, JP-A-6-347929, JP-A-9-34045 and JP-A-9-96881. Since the bromide and the iodide are different from the chloride in crystal lattice size, they give rise to distortions in nuclei and thereby crystal defects to cause anisotropic crystal growth, such as screw dislocations, are introduced to the nuclei. Once the screw dislocation has been introduced, the formation of two-dimensional nuclei on the plane having a screw dislocation is no longer a rate-limiting step in the grain growth under conditions of low supersaturation; as a result, crystallization proceeds on this plane. Therefore, the introduction of screw dislocations can lead to the formation of tabular grains. The term "conditions of low supersaturation" as used herein means 35% or less, preferably 2 to 20%, of critical supersaturation upon addition. Although it is not definitely established that the crystal defects are screw dislocations, the crystal defects are thought to be screw dislocations in a high probability, judging from the direction in which the dislocations are introduced and the fact that the anisotropic growth is induced. JP-A-8-122954 and JP-A-9-189977 disclose that the retention of such dislocations introduced is favorable for making the tabular grains thinner.

The mixing upon nucleation is important for forming tabular grains monodisperse in thickness, so that it is required to mix the aqueous solutions of silver nitrate and halides in a short time with stirring at a high efficiency. When the mixing apparatus disclosed in JP-A-51-83097 is used, it is desirable that the stirring be performed at 800 to 2,000 r.p.m., particularly 1,000 to 2,000 r.p.m.

In another method for forming the {100} tabular grains, (100) face forming accelerators are added. As such accelerators, JP-A-6-347928 discloses imidazoles and 3,5-diaminotriazolesl, while JP-A-8-339044 discloses polyvinyl alcohols. However, the invention should not be construed as being limited to those methods.

In the silver halide emulsion of the present invention, the tabular grains having a distance between the main planes of 0.13 $\mu$m or less and an aspect ratio of at least 2 occupy at least 90% of the total grains based on the total projected area of the total silver halide grains in the emulsion. With respect to the shape of tabular grains, each grain generally has two parallel planes. These parallel planes are referred to as the main planes, and a distance between the main planes is defined as a thickness. The thickness is desirably 0.1 $\mu$m or less, particularly desirably from 0.02 to 0.08 $\mu$m. Uniformity is essential for grain thickness, and so it is required that the silver halide tabular grains of the present invention have a variation coefficient (a value obtained by dividing a standard deviation by a mean value) of 20% or less, preferably 16% or less, with respect to the grain thickness. The grain thickness can be determined by the shadow length from electron microscope photography utilizing a carbon replica process in combination with metal deposition.

The average equivalent circle diameter of the total tabular grains can be arbitrarily chosen from the range of 0.3 to 10 μm. The term "equivalent circle diameter" as used herein means the diameter of a circle having the same area as the projected area of a grain in an electron microscope photography. Further, the diameter/thickness ratio is referred to as the aspect ratio. When the grains are used in a photosensitive material for rapid processing, it is desirable for them to have their individual equivalent circle diameters in the small-size range of 0.3 to 0.8 μm. In this small-size range, the processing stability decreases due to dissolution physical development, so that the present invention can fully achieve its effects. Therefore, this range is especially important for the the present invention. Moreover, it is desirable that the distribution of equivalent circle diameters of grains be monodisperse, and the present invention can have the greatest effects when the variation coefficient of equivalent circle diameter is not higher than 22%.

The average aspect ratio is desirably at least 5, preferably from 8 to 20.

The tabular grains of the present invention are grains having silver chloride content of at least 95 mole %, particularly preferably at least 98 mole %.

The tabular grains of the present invention, though may be uniform in structure, preferably have the so-called core/shell structure, that is, the structure constituted of a core part and a shell part surrounding the core part. In the core part, it is desirable that at least 95% of the silver halide be silver chloride. The core part may be made up of two or more sections differing in halide composition. For the shell part, it is desirable to occupy 50% or less, particularly 20% or less, of the total volume of each grain.

It is desirable for the tabular grains of the present invention to contain silver iodide in a proportion of 0.1 mole % to 0.8 mole % based on the total silver. In particular, the iodide content of 0.2 mole % to 0.6 mole % is desirable. The silver iodide is preferably contained in the shell part (outermost layer). The iodide content in the shell part is desirably from 1.0 mole % to 13 mole %, especially from 2 mole % to 10 mole %. By containing silver iodide, the effect of a monodispersed thickness distribution upon processing stability is enhanced.

By containing silver bromide also, it is possible to enhance the effect of a monodispersed thickness distribution upon processing stability.

The suitable bromide content is from 0.1 mole % to 4 mole %. It is desirable that the bromide content be higher in the shell part than in the core part. Further, it is desirable that the phase differing in a bromide content by at least 6 mole % (bromide-localized phase) from the other phases be present inside the grains. Preferably, the bromide-localized phase at least 6 mole % higher in bromide content than the other phases is present in the shell part. The bromide-localized phase desirably contains an iridium compound in a proportion of $1\times10^{-8}$ mole % to $1\times10^{-6}$ mole % based on the total silver in each grain, and thereby the shape of tabular grains is stabilized and photographic properties under high intensity exposure are improved.

The crystal habit control agent existing on the grain surfaces after grain formation influences the adsorption of sensitizing dyes and the development. Therefore, it is desirable that the crystal habit control agent be removed after grain formation. When the crystal habit control agent is removed, however, it becomes difficult for high-silver chloride grains to maintain (111) faces under usual conditions. Therefore, it is desirable to replace the crystal habit control agent with a photographically useful compound, such as a sensitizing dye, and thereby to retain the grain shape. The methods for grain shape retention are disclosed in, e.g., JP-A-9-80656, JP-A-9-106026, and U.S. Pat. Nos. 5,221,602, 5,286,452, 5,298,387, 5,298,388 and 5,176,992.

The crystal habit control agent desorbed from the grains in accordance with such a method as mentioned above is desirably removed from the emulsion by washing with water. The washing can be carried out at a temperature not causing the coagulation of gelatin generally used as protective colloid. As to the washing method, known techniques, such as flocculation and ultrafiltration, can be adopted. Specifically, when the crystal habit control agent used in the present invention is a pyridinium salt, the suitable washing temperature is preferably 40° C. or above, particularly preferably 50° C. or above.

The desorption of a crystal habit control agent from grains is promoted under low pH. In the processing step, therefore, the lower pH is preferable as far as it does not cause too much aggragation among grains.

The silver halide grains of the present invention can contain ions or complex ions of metals belonging to group VIII of the Periodic Table, such as osmium, iridium, rhodium, platinum, ruthenium, palladium, cobalt, nickel or iron, alone or in combination. Therein, two or more of these metals may be used.

The compounds donating the foregoing metal ions may be added to an aqueous gelatin solution functioning as dispersing medium, an aqueous halide solution, an aqueous silver salt solution or another aqueous solution during silver halide grains formation, or the fine silver halide grains previously containing metal ions may be added to the silver halide emulsion and dissolved therein to result in incorporation of the metal ions in the silver halide emulsion grains. The treatment for incorporating metal ions into the grains can be carried out before, during or just after the grain formation. In other words, it can be made at any stage of grain formation, but the stage is chosen depending on the location intended for the metal ions inside the grains and the amount of metal ions to be incorporated.

In the silver halide grains of the present invention, it is desirable that at least 50 mole %, preferably at least 80 mole %, more preferably 100 mole %, of the metal-ion donating compounds used be localized in the surface layer the volume of which corresponds to 50% or less, preferably 30% or less, of the total grain volume. The localization of metal ions in the surface layer can inhibit an increase in internal sensitivity, so that it is advantageous for achievement of high sensitivity. Such concentrative incorporation of metal ion-donating compounds in the surface layer can be effected, e.g., by first forming silver halide grains to constitute the core part (the part other than the surface layer), and then adding aqueous solutions of water-soluble silver salt and halides while supplying the metal ion-providing compounds thereto, thereby forming the surface layer of the grains.

In addition to the group VIII metals, various polyvalent metal ion impurities can be introduced into the silver halide emulsion of the present invention in the process of forming or physically ripening the emulsion grains. The amount of these impurities added can cover a wide range depending on the purpose of their introduction. Specifically, the suitable addition amount is from $10^{-9}$ to $10^{-2}$ mole per mole of the silver halide.

The silver halide emulsions used in the present invention are generally chemically sensitized. Examples of a method for chemical sensitization include the so-called gold sensitization methods using gold compounds (disclosed, e.g., in U.S. Pat. Nos. 2,448,060 and 3,320,069), sensitization methods using metals, such as iridium, platinum, rhodium and palladium (disclosed, e.g., in U.S. Pat. Nos. 2,448,060, 2,566,245 and 2,556,263), sulfur sensitization methods using sulfur-containing compounds (disclosed, e.g., in U.S. Pat. No. 2,222,264), selenium sensitization methods using selenium compounds, tellurium sensitization methods using tellurium compounds, and reduction sensitization methods using tin salts, thiourea dioxide or polyamines (disclosed, e.g., in U.S. Pat. Nos. 2,487,850, 2,518,698 and 2,521,925). These sensitization methods can be used alone or in combination.

The silver halide emulsions used in the present invention are preferably emulsions subjected to gold sensitization known in this industry. This is because the gold sensitization can further reduce the variations caused in photographic properties by exposure to scanning laser beams or the like. For gold sensitization, chloroauric acid or salts thereof, gold thiocyanates and gold thiosulfates can be used. The amounts of these compounds added, though can be changed depending on the situation, range from $5\times10^{-7}$ to $5\times10^{-2}$ mole, preferably from $1\times10^{-6}$ to $1\times10^{-3}$ mole, per mole of silver halide. The addition of those compounds is carried out before the completion of all the chemical sensitization treatments adopted for the present invention.

It is also desirable in the present invention that any of sensitization methods other than gold sensitization, e.g., sulfur sensitization, selenium sensitization, tellurium sensitization, reduction sensitization and noble sensitization using noble metals other than gold compound, be used in combination with gold sensitization.

To the silver halide emulsions used in the present invention, various compounds or precursors thereof can be added for the purpose of preventing the generation of fog during the production, storage or photographic processing, or stabilizing the photographic properties. Suitable examples of those compounds are the compounds disclosed in JP-A-62-215272, pages 39 to 72. The emulsions used in the present invention are preferably a so-called surface latent image type emulsion in which the latent image is mainly formed on the surface of the grains.

It is desirable that the silver halide emulsion layer comprising the tabular grains of the present invention be arranged farther from the support than other light-sensitive layers, or at the location near the surface of the photosensitive material so as to be at a short distance from processing solutions.

This is because the dissolution physical development by a fix-bleaching solution is more serious for the silver halide grains in a layer near the processing solution. In the case of rapid development-processing, it is required to perform the processing with a highly active fix-bleaching solution at a high temperature; as a result, the dissolution of silver halide grains is promoted. Therefore, the effects of the present invention are important in the case of rapid processing.

There are no particular restrictions as to additives used for the present photographic emulsions, the layer structure as a photographic light-sensitive material using the photographic emulsion of the present invention, and the compositions of processing solutions including a developer. For those elements, the descriptions in the following documents can be referred to.

| Photographic constitutional element | JP-A-7-104448 | JP-A-7-310895 |
|---|---|---|
| Support | column 7, line 12, to column 12, line 19 | column 5, line 40, to column 9, line 26 |
| Stabilizer, Antifoggant | column 75, lines 9–18 | column 18, line 11, to column 31, line 37 |
| Chemical sensitizer | column 74, line 45, to column 75, 6 line | column 81, lines 9–17 |
| Spectral sensitizer | column 75, line 19, to column 76, line 45 | column 81, line 21, to column 82, line 48 |
| Cyan coupler | column 12, line 20, to column 39, line 49 | column 88, line 49, to column 89, line 19 |
| Yellow coupler | column 87, line 40, to column 88, line 3 | column 89, lines 19–30 |
| Magenta coupler | column 88, line 4, to column 89, line 19 | column 32, line 34, to column 77, line 44 |
| Method for emulsified dispersion | column 71, line 3, to column 72, line 11 | column 87, lines 35–48 |
| Color image stabilizer | column 39, line 50, to column 70, line 9 | column 87, line 49, to column 88, line 48 |
| Discoloration inhibitor | column 70, line 10, to column 71, line 2 | |
| Dyes | column 77, line 42, to column 78, line 41 | column 9, line 27, to column 18, line 10 |
| Layer structure | column 39, lines 11–26 | column 31, line 38, to column 32, line 33 |
| Scanning exposure | column 76, line 6, to column 77, line 41 | column 82, line 49, to column 83, line 12 |
| Developer | column 88, line 19, to column 89, line 22 | |

Now, the invention will be illustrated in greater detail by reference to the following examples.

EXAMPLE 1

<Preparation of Tabular Grains>

Experiment 1 (Comparison): Superfine high-silver chloride {111} tabular grains (A)

A solution containing 2.0 g of sodium chloride and 2.4 g of inert gelatin in 1.2 liter of water was placed in a reaction vessel and kept at 33° C. Thereto, 60 ml of an aqueous solution containing 9 g of silver nitrate and 60 ml of an aqueous solution containing 3.22 g of sodium chloride were added over a 1-minute period with stirring by a double jet method. After a 1-minute lapse from the completion of the addition, 40 ml of an aqueous solution containing 0.8 millimole of a crystal habit control Agent 1 (illustrated below) was added. After additional one minute, 2.0 g of sodium chloride was added. Then, 25 minutes were spent for raising the temperature of the reaction vessel to 60° C., and the temperature of 60° C. was kept for 16 minutes to achieve the ripening. At least 90%, based on the projected area, of the thus formed grains (A) were tabular grains having an aspect ratio of at least 2, an average equivalent circle diameter of 0.28 μm and an average thickness of 0.08 μm. The variation coefficient of thickness was 35.1%.

Crystal Habit Control Agent 1

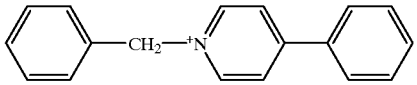

Experiment 2 (Invention): Superfine high-silver chloride {111} tabular grains (B)

The grain formation was carried out in the same manner as in Experiment 1, except that 290 ml of a 10% phthalated gelatin solution was added simultaneously with the addition of the crystal habit control Agent 1. At least 95%, based on the total projected area, of the thus obtained grains (B) were tabular grains having an aspect ratio of at least 2, an average equivalent circle diameter of 0.32 μm and an average thickness of 0.074 μm. The variation coefficient of thickness was 19.8%.

Experiment 3 (Invention): Superfine high-silver chloride {111} tabular grains (C)

The grain formation was carried out in the same manner as in Experiment 1, except that 490 ml of a 10% phthalated gelatin solution was added simultaneously with the addition of the crystal habit control Agent 1. At least 95%, based on the total projected area, of the thus obtained grains (C) were tabular grains having an aspect ratio of at least 2, an average equivalent circle diameter of 0.34 μm and an average thickness of 0.070 μm. The variation coefficient of thickness was 14.6%.

Experiment 4 (Comparison): Grains (D) having grown from grains (A)

After the ripening in Experiment 1, 290 ml of a 10% phthalated gelatin solution, 0.8 millimole of the crystal habit control Agent 1 and 3.0 g of NaCl were added. After the completion of the addition, an aqueous solution containing 113.1 g of silver nitrate and an aqueous solution containing 41.3 g of NaCl were added at respectively accelerated flow rates over a 40-minute period. For 10 minutes before the completion of the addition, $1\times10^{-5}$ mole of potassium ferrocyanide was also added at a constant flow rate. After the completion of the addition, 2.8 millimoles of KSCN and 0.8 millimole of a sensitizing Dye A as illustrated below were added, and then stirred for 20 minutes at a temperature of 75° C.

Sensitizing Dye A

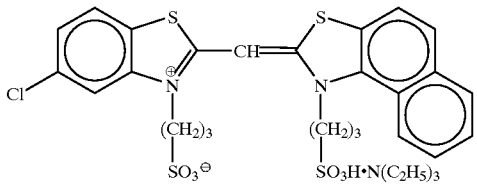

After the temperature was lowered to 40° C., the washing was carried out using an ordinary flocculation method. After washing, 67 g of gelatin, 80 ml of phenol (5%) and 150 ml of distilled water were added. The thus obtained emulsion was adjusted to pH 6.2 and pAg 7.5 by the addition of sodium hydroxide and a silver nitrate solution. At least 95%, based on the total projected area, of the thus formed grains (D) were tabular grains having an average equivalent circle diameter of 1.32 μm and an average thickness of 0.127 μm. The variation coefficient of thickness was 30.6%, and the variation coefficient of equivalent circle diameter was 24.0%.

Experiment 5 (Invention): Grains (E) having grown from grains (B)

After the ripening in Experiment 2, an aqueous solution containing 113.1 g of silver nitrate and an aqueous solution containing 41.3 g of NaCl were added at respectively accelerated flow rates over a 40-minute period. Simultaneously with the addition of these solutions, 0.8 millimole of the crystal habit control Agent 1 was added at an accelerated flow rate (proportional to the amount of silver nitrate added). For 10 minutes before the completion of the addition, $1\times10^{-5}$ mole of potassium ferrocyanide was further added at a constant flow rate. After the completion of the addition, 2.8 millimoles of KSCN and 0.8 millimole of the sensitizing Dye A were added, and then allowed to stand for 15 minutes at 75° C.

After the temperature was lowered to 40° C., the washing was carried out using an ordinary flocculation method. After washing, 67 g of gelatin, 80 ml of phenol (5%) and 150 ml of distilled water were added. The thus obtained emulsion was adjusted to pH 6.2 and pAg 7.5 by the addition of sodium hydroxide and a silver nitrate solution. At least 95%, based on the total projected area, of the thus formed grains (E) were tabular grains having an average equivalent circle diameter of 1.41 μm and an average thickness of 0.116 μm. The variation coefficient of thickness was 18.9%, and the variation coefficient of equivalent circle diameter was 22.0%.

Experiment 6 (Invention): Grains (F) having grown from grains (C)

After the ripening in Experiment 3, the grain formation and the preparation of the emulsion were carried out in the same manner as in Experiment 5. At least 95%, based on the total projected area, of the thus formed grains (F) were tabular grains having an average equivalent circle diameter of 1.46 μm and an average thickness of 0.113 μm. The variation coefficient of thickness was 14.9%, and the variation coefficient of equivalent circle diameter was 20.1%.

Experiment 7 (Comparison): Small-size {111} tabular grains

A solution containing 2.0 g of sodium chloride and 2.4 g of inert gelatin in 1.2 liter of water was placed in a reaction vessel and kept at 33° C. Thereto, 45 ml of an aqueous solution containing 18 g of silver nitrate and 45 ml of an aqueous solution containing 6.2 g of sodium chloride were added over a 1-minute period with stirring by a double jet method. After a 1-minute lapse from the completion of the addition, 0.8 millimole of the crystal habit control Agent 1 was added. After additional one-minute lapse, 1.0 g of sodium chloride was added. Then, the temperature of the reaction vessel was raised up to 60° C. over a period of 25 minutes, and kept at 60° C. for 16 minutes to achieve ripening. Thereafter, 560 g of a 10% aqueous solution of phthalated gelatin was added. Then, 0.8 millimole of the crystal habit control Agent 1 was further added. Subsequently thereto, the pCl in the reaction vessel was adjusted to 1.24. Then, 255 ml of an aqueous solution containing 102 g of silver nitrate and 255 ml of an aqueous solution containing 35.3 g of sodium chloride were added at respectively accelerated flow rates over a period of 11 minutes. From 9 minutes on to 11 minutes after the addition of those solutions began, an aqueous solution containing 3 mg of potassium ferrocyanate was added.

Thereafter, 27 ml of a 1% potassium thiocyanate, $4.8\times10^{-4}$ mole/mole Ag of a sensitizing Dye B and $3.2\times10^{-4}$ mole/mole Ag of a sensitizing Dye C were further added.

Then, the reaction system was heated to 75° C. and stirred for 20 minutes as the temperature was kept at 75° C.

Sensitizing Dye B

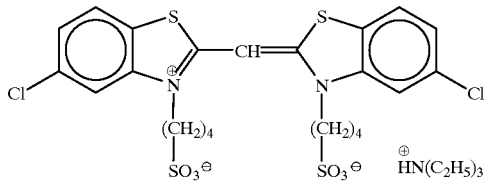

Sensitizing Dye C

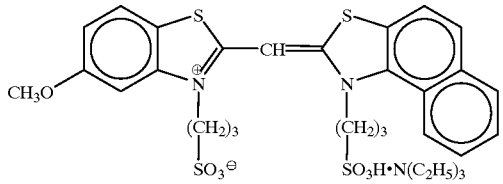

After the temperature was lowered to 40° C., the washing was carried out using an ordinary flocculation method. After washing, 67 g of gelatin, 80 ml of phenol (5%) and 150 ml of distilled water were added. The thus obtained emulsion was adjusted to pH 6.2 and pAg 7.5 by the addition of sodium hydroxide and a silver nitrate solution. The thus obtained emulsion comprised pure silver chloride tabular grains (G), at least 95%, based on the total projected area, of which were tabular grains having an aspect ratio of at least 2. The tabular grains (G) had an average equivalent circle diameter of 0.54 μm and an average thickness of 0.111 μm, and their variation coefficients of thickness and equivalent circle diameter were 21.5% and 24.3% respectively.

Experiment 8 (Invention): Small-size {111} tabular grains (H)

The grain formation was carried out in the same manner as in Experiment 7, except that after 1 minute from the completion of the nucleation 560 ml of a 10% aqueous solution of phthalated gelatin was added simultaneously with the addition of the crystal habit control agent. At the time the ripening was carried out for 16 minutes, silver halide grains were sampled and electron micrographs thereof were taken (See FIG. 1). According to FIG. 1, the average equivalent circle diameter of these tabular grains is 0.29 μm and the average thickness thereof is 0.07 μm. The finally obtained emulsion comprised tabular grains (H), at least 95%, based on the total projected area, of which were tabular grains having an aspect ratio of at least 2. These tabular grains (H) had an average equivalent circle diameter of 0.58 μm and an average thickness of 0.102 μm, and their variation coefficients of thickness and equivalent circle diameter were 16.6% and 19.5% respectively.

Experiment 9 (Invention): Small-size iodide-containing {111} tabular grains (I)

Figure 2:
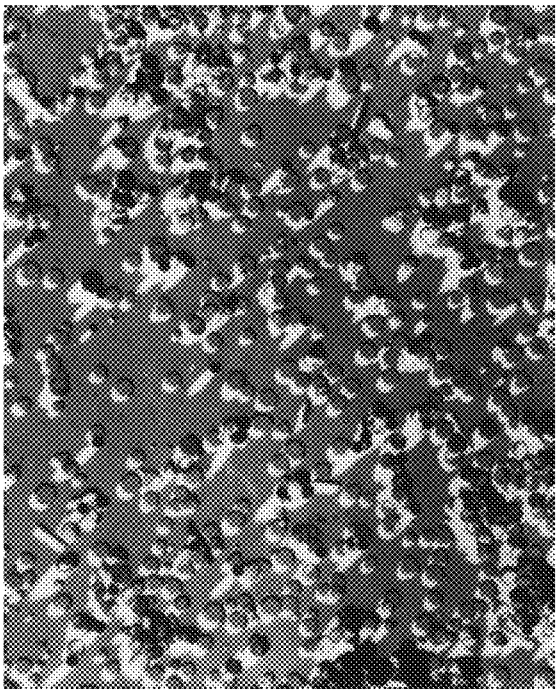
FIG. 2 is an electron microscope photograph showing the crystal structure of the final silver halide grains prepared in Example 9. The magnification thereof was 3,000. The black spots in the electron microscope photograph are latex balls having a diameter of 0.5 μm.

The grain formation was carried out in the same manner as in Experiment 8, except that at the last stage of grain formation, from 9 minutes on to 11 minutes, an aqueous solution containing 0.24 g of KI was added together with 3 mg of potassium ferrocyanide. The thus obtained emulsion comprised tabular grains (I), at least 95%, based on total projected area, of which were tabular grains having an aspect ratio of at least 2. These tabular grains (I) had an average equivalent circle diameter of 0.58 μm and an average thickness of 0.104 μm. The electron micrograph of the tabular grains (I) is shown in FIG. 2. These tabular grains had variation coefficients of 18.6% and 21.5% with respect to the thickness and the equivalent circle diameter respectively.

Experiment 10 (Invention): Iodide- and bromide-containing {111} tabular grains (J)

After forming grains in the same manner as in Experiment 9, an aqueous solution containing 1.2 g of silver nitrate and an aqueous solution containing 0.84 g of KBr and 8×10−8 mole of iridium hexachloride were further added over a 5-minute period at constant flow rates. Thereafter, the washing was carried out using the same method as in Experiment 9. The thus obtained emulsion comprised tabular grains (J), at least 95%, based on the projected area, of which were tabular grains having an aspect ratio of at least 2. These tabular grains (J) had an average equivalent circle diameter of 0.60 μm and an average thickness of 0.102 μm, and their variation coefficients of thickness and equivalent circle diameter were 17.3% and 20.8% respectively.

Experiment 11 (Comparison): {100} Tabular grains (K)

In the reaction vessel disclosed in JP-A-51-83097, a mixture of 1,200 ml of water, 25 g of gelatin (demineralized alkali-processed ossein gelatin having a methionine content of about 40 μ mole/g), 1 g of NaCl and 4.5 ml of 1N $HNO_3$ solution was placed and thermostated at 40° C. The pH of this mixture was 4.5. To the mixture with stirring at 250 r.p.m, a solution containing $AgNO_3$ in a concentration of 0.2 g/ml (Solution Ag-1) and a solution containing NaCl in a concentration of 0.069 g/ml (Solution X-1) were added simultaneously for 15 seconds at the flow rate of 48 ml/min. After a 3-minute lapse, a solution containing KBr in a concentration of 0.012 g/ml (Solution X-2) was further added for 20 seconds at the flow rate of 60 ml/min. After additional 3-minute lapse, the Solutions Ag-1 and X-1 were furthermore added simultaneously for 45 seconds at the flow rate of 48 ml/min. Then, the number of revolutions for stirring was increased to 750 r.p.m. After the resulting reaction mixture was stirred for 1 minute, thereto was added an aqeuous gelatin solution (containing 10 g of gelatin, 7 ml of 1N NaOH and 1.7 g of NaCl in 120 ml of water). After a 4-minute lapse, the temperature was raised to 75° C. over a 12-munite period, and the ripening was carried out for 25 minutes. Further, 7.5 ml of a solution containing 0.01 g/ml of KI was added, and the ripening was further continued for 5 minutes. Thereafter, the sensitizing Dyes B and C were added in the amounts of $4.8\times10^{-4}$ mole/mole Ag and $3.2\times10^{-4}$ mole/mole Ag respectively, and the stirring was continued for additional 20 minutes.

The temperature was lowered to 40° C., and then the washing was carried out using an ordinary flocculation method. After washing, gelatin and distilled water were added so that the gelatin content was made 0.1 g per gram of emulsion. Further, the emulsion obtained was adjusted to pH 6.2 and pAg 7.5 by the addition of sodium hydroxide and sodium chloride. Therefrom, emulsion grains was sampled, and the electron micrographic images (TEM images) as the replicas of these grains were observed. As a result of the observation, it was found that 96%, based on the total projected area, of the total AgX grains were tabular grains having (100) faces as the main planes, and these tabular grains had the average equivalent circle diameter of 0.68 μm, the variation coefficient of 20.4% with respect to the equivalent circle diameter, the average distance between the main planes of 0.12 μm, and the variation coefficient of 33.4% with respect to the distance between the main planes, and the average aspect ratio of 6.6.

Experiment 12 (Invention): {100} Tabular grains (L)

In the reaction vessel disclosed in JP-A-51-83097, a mixture of 1,200 ml of water, 25 g of gelatin (demineralized alkali-processed ossein gelatin having a methionine content of about 40 $\mu$ mole/g), 1 g of NaCl and 4.5 ml of 1N $HNO_3$ solution was placed and thermostated at 40° C. (the pH of this mixture was 4.5). To the mixture with stirring at 1,200 r.p.m, the solution Ag-1 (containing 0.2 g/ml of $AgNO_3$) and the solution X-1 (containing 0.069 g/ml of NaCl) were added simultaneously for 15 seconds at the flow rate of 48 ml/min. After a 3-minute lapse, the solution X-2 (containing 0.012 g/ml of KBr) was further added for 20 seconds at the flow rate of 60 ml/min. After additional 3-minute lapse, the solutions Ag-1 and X-1 were furthermore added simultaneously for 45 seconds at the flow rate of 48 ml/min. Then, the number of revolutions for stirring was decreased to 750 r.p.m. After the resulting reaction mixture was stirred for 1 minute, thereto was added an aqueous gelatin solution (containing 10 g of gelatin, 7 ml of 1N NaOH and 1.7 g of NaCl in 120 ml of water). After a 4-minute lapse, the temperature was raised to 75° C. over a 12-munite period, and the ripening was carried out for 25 minutes. Further, 7.5 ml of a solution containing 0.01 g/ml of KI was added, and the ripening was further continued for 5 minutes. Thereafter, the sensitizing Dyes B and C were added in the amounts of $4.8\times10^{-4}$ mole/mole Ag and $3.2\times10^{-4}$ mole/mole Ag respectively, and the stirring was continued for additional 20 minutes.

The temperature was lowered to 40° C., and then the washing was carried out using an ordinary flocculation method. After washing, gelatin and distilled water were added so that the gelatin content was made 0.1 g per gram of emulsion. Further, the emulsion obtained was adjusted to pH 6.2 and pAg 7.5 by the addition of sodium hydroxide and sodium chloride. Therefrom, emulsion grains was sampled, and the electron micrographic images (TEM images) as the replicas of these grains were observed. As a result of the observation, it was found that 98%, based on the total projected area, of the total AgX grains were tabular grains having (100) faces as the main planes, and these tabular grains had the average equivalent circle diameter of 0.66 $\mu$m, the variation coefficient of 16.7% with respect to the equivalent circle diameter, the average distance between the main planes of 0.11 $\mu$m, and the variation coefficient of 14.9% with respect to the distance between the main planes, and the average aspect ratio of 7.3.

Experiment 13: Chemically sensitized emulsions

Each of the emulsions prepared in Experiments 4 to 12 was chemically sensitized at 60° C. to the optimum extent by the use of sodium thiosulfonate, 1-(5-methylureido-phenyl)-5-mercaptotetrazole, sodium thiosulfate and chloroauric acid. Thus, chemically sensitized Emulsions D to L were prepared.

Experiment 14: Preparation of coated samples and evaluation of photographic properties and stability The surface of a paper support coated with polyethylene resin on both sides was subjected to corona discharge treatment, and then provided with a gelatin subbing layer to which sodium dodecylbenzenesulfonate was added. On the subbing layer, the first to the seventh photographic constituent layers were coated one after another to prepare a silver halide color photographic material as a coated sample, which had the compositions as illustrated below in the constituent layers respectively.

The coating solutions for photographic constituent layers were prepared in the following manners respectively.

<Preparation of Coating Solutions>

Couplers, image stabilizers and ultraviolet absorbents were dissolved in certain solvents and ethyl acetate, and the solution obtained was emulsified and dispersed in a 10 weight % aqueous gelatin solution containing a surfactant by means of a high speed-agitation emulsifying machine (dissolver) to prepare an emulsified dispersion.

The emulsified dispersion was mixed with an emulsion having a high chloride content so as to have the composition as described below, thereby preparing a coating solution.

To a coating solution for each constituent layer, sodium 1-oxy-3,5-dichloro-s-triazine as a gelatin-hardening agent and preservatives (antiseptics) Ab-1, Ab-2 and Ab-3 were added so that their respective total contents in each coated sample were 15.0 mg/m$^2$, 5.0 mg/m$^2$ and 10.0 mg/m$^2$.

Ab-1

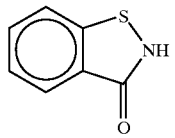

Ab-2

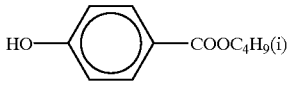

Ab-3

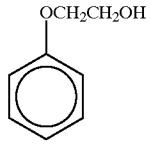

The high chloride content emulsion used for each light-sensitive emulsion layer is as follows:

Blue-sensitive emulsion layer

Each of the emulsions shown in Table 1.

Green-sensitive emulsion layer

A 1:3 (silver mol ratio) mixture of large-sized and small-sized silver chlorobromide emulsions. Both of these emulsions had a cubic crystal form, one of which had an average grain size of 0.45 $\mu$m and a variation coefficient of 10% with respect to the grain size distribution (large-sized Emulsion G1), and the other of which had an average grain size of 0.35 $\mu$m and a variation coefficient of 8% with respect to the grain size distribution (small-sized Emulsion G2), and both of them contained 0.4 mole % of silver bromide wherein the bromide was localized in part of the surface of the-grain mainly comprising silver chloride. Further, sensitizing Dyes D and E illustrated below were added to the Emulsion G1 in the amounts of $3.0\times10^{-4}$ mole and $4.0\times10^{-5}$ mole, respectively, per mole of silver halide, while they were added to the Emulsion G2 in the amounts of $3.6\times10^{-4}$ mole and $2.8\times10^{-4}$ mole/mole, respectively, per mole of silver halide.

Sensitizing Dye D

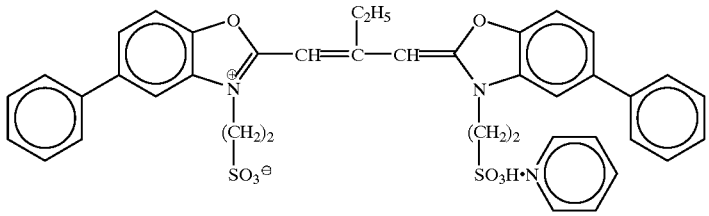

Sensitizing dye E

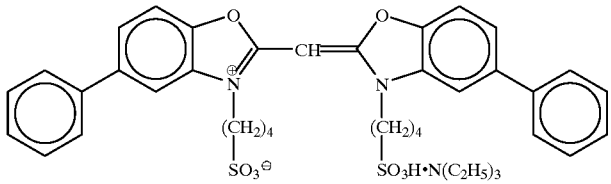

Red-sensitive emulsion layer

A 1:1 (silver mol ratio) mixture of large-sized and small-sized silver chlorobromide emulsions. Both of these emulsions had a cubic crystal form, one of which had an average grain size of 0.40 $\mu$m and a variation coefficient of 9% with respect to the grain size distribution (large-sized Emulsion R1), and the other of which had an average grain size of 0.30 $\mu$m and a variation coefficient of 11% with respect to the grain size distribution (small-sized Emulsion $R_2$), and both of them contained 0.5 mole % of silver bromide wherein the bromide was localized in part of the surface of the grain mainly comprising silver chloride. Further, sensitizing Dyes G and H illustrated below were added to the Emulsion R1 in the same amount of $9.0\times10^{-5}$ mole/mole-silver halide, while they were added the Emulsion $R_2$ in the amount of $1.2\times10^{-4}$ mole/mole-silver halide. Furthermore, Compound I illustrated below was added in the amount of $3.0\times10^{-3}$ mole/mole silver halide.

Sensitizing Dye G

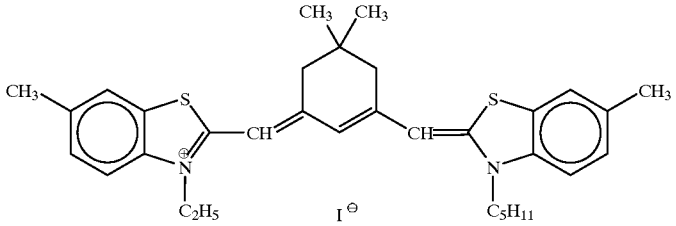

Sensitizing dye H

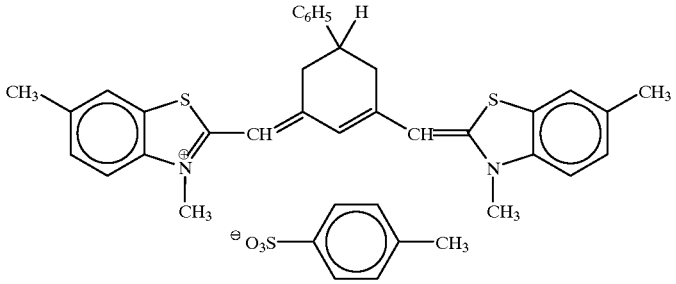

-continued

Compound I

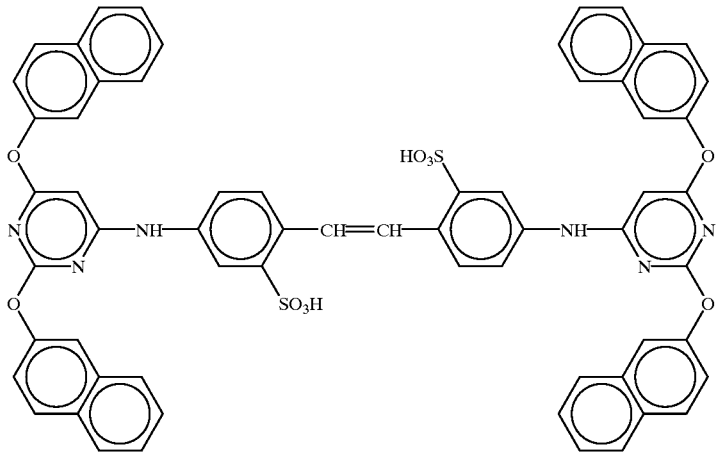

In addition, 1-(3-methylureidophenyl)-5-mercaptoteterazole was added to the blue-sensitive, green-sensitive and red-sensitive emulsion layers in the amounts of $3.3\times10^{-4}$ mole, $1.0\times10^{-3}$ mole and $5.9\times10^{-4}$ mole, respectively, per mole of silver halide.

Further, 1-(3-methylureidophenyl)-5-mercaptotetrazole was also added to the second layer, the fourth layer, the sixth layer and the seventh layer so as to have the coverage (i.e., the coating amount) of 0.2 mg/m$^2$, 0.2 mg/m$^2$, 0.6 mg/m$^2$ and 0.1 mg/m$^2$ respectively.

Furthermore, 4-hydroxy-6-methyl-1,3,3a,7-tetraazaindene was added to the blue-sensitive emulsion layer and the green-sensitive emulsion layer in the amounts of $1\times10^{-4}$ mole and $2\times10^{-4}$ mole, respectively, per mole of silver halide.

To the red-sensitive emulsion layer, methacrylic acid/butyl acrylate (1/1 by weight) copolymer having average molecular weight of 200,000 to 400,000 was further added so as to have the coverage of 0.05 g/m$^2$.

In addition, disodium catechol-3,5-disulfonate was added to the second layer, the fourth layer and the sixth layer so as to have the coverage of 6 mg/m$^2$, 6 mg/m$^2$ and 18 mg/m$^2$ respectively.

Further, the dyes illustrated below (their respective coverage rates are designated in parentheses) were added in order to inhibit an irradiation phenomenon from occurring.

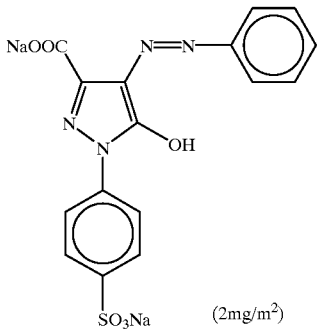

(2mg/m$^2$)

-continued

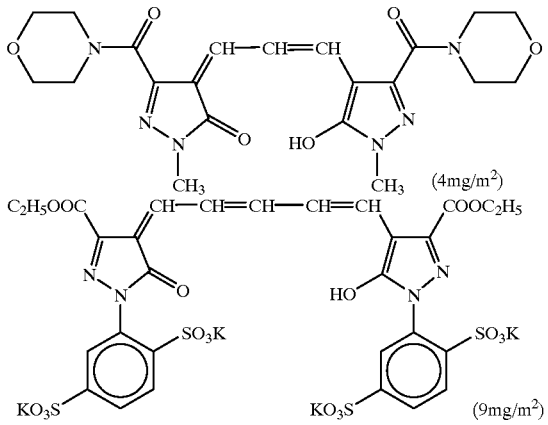

(4mg/m$^2$)

(9mg/m$^2$)

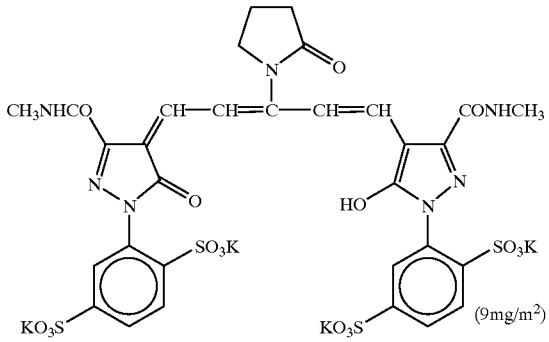

(9mg/m$^2$)

<Layer Constitution>

The composition of each constituent layer is described below. Each figure on the right side designates the coverage (g/m$^2$) of the ingredient corresponding thereto. As to the silver halide emulsion, the figure represents the coverage based on silver.

Support:

Polyethylene resin-laminated paper containing as white pigments $TiO_2$ in the proportion of 16 weight % and ZnO in the proportion of 4 weight %, as a brightening agent 4,4'-bis(5-methylbenzoxazolyl)stilbene at the coverage of 13 mg/m$^2$ and as a bluish dye (ultramarine) at the coverage of 96 mg/m$^2$ in the polyethylene resin laminate on the side of the first layer.

| First Layer (red-sensitive emulsion layer): | |
|---|---|
| The foregoing red-sensitive emulsion | 0.12 |
| Gelatin | 0.59 |
| Cyan coupler (EXC-1) | 0.13 |
| Cyan coupler (EXC-2) | 0.03 |
| Color stain inhibitor (Cpd-7) | 0.01 |
| Color image stabilizer (Cpd-9) | 0.04 |
| Color image stabilizer (Cpd-15) | 0.19 |
| Color image stabilizer (Cpd-18) | 0.04 |
| Solvent (Solv-5) | 0.09 |
| **Second Layer (color stain inhibiting layer)** | |
| Gelatin | 0.60 |
| Color stain inhibitor (Cpd-19) | 0.09 |
| Color stain inhibiting aid (Cpd-5) | 0.007 |
| Color stain inhibitor (Cpd-7) | 0.007 |
| Ultraviolet absorbent (UV-C) | 0.05 |
| Solvent (Solv-5) | 0.11 |
| **Third Layer (green-sensitive emulsion layer)** | |
| The foregoing green-sensitive emulsion | 0.14 |
| Gelatin | 0.73 |
| Magenta coupler (EXM) | 0.15 |
| Ultraviolet absorbent (UV-A) | 0.05 |
| Color image stabilizer (Cpd-2) | 0.02 |
| Color stain inhibitor (Cpd-7) | 0.008 |
| Color image stabilizer (Cpd-8) | 0.07 |
| Color image stabilizer (Cpd-9) | 0.03 |
| Color image stabilizer (Cpd-10) | 0.009 |
| Dye (Cpd-11) | 0.0001 |
| Solvent (Solv-3) | 0.06 |
| Solvent (Solv-4) | 0.11 |
| Solvent (Solv-5) | 0.06 |

-continued

| Fourth Layer (color stain inhibiting layer): | |
|---|---|
| Gelatin | 0.48 |
| Color stain inhibitor (Cpd-4) | 0.07 |
| Color stain inhibiting aid (Cpd-5) | 0.006 |
| Color stain inhibitor (Cpd-7) | 0.006 |
| Ultraviolet absorbent (UV-C) | 0.04 |
| Solvent (Solv-5) | 0.99 |
| **Fifth Layer (Blue-sensitive emulsion layer):** | |
| Emulsion shown in Table 1 | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |
| **Sixth Layer (ultraviolet absorbing layer):** | |
| Gelatin | 0.32 |
| Ultraviolet absorbent (UV-C) | 0.42 |
| Solvent (Solv-7) | 0.08 |
| **Seventh Layer (protective layer):** | |
| Gelatin | 0.70 |
| Acryl-modified copolymer of polyvinyl alcohol (modification degree: 17%) | 0.04 |
| Liquid paraffin | 0.01 |
| Surfactant (Cpd-13) | 0.01 |
| Polydimethylsiloxane | 0.01 |
| Silicon dioxide | 0.003 |

The structural formulae of the ingredients used herein are illustrated below:

(ExY) Yellow Coupler
70:30 (by mole) mixture of

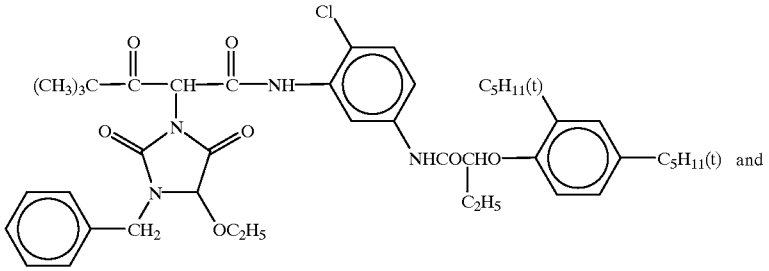

and

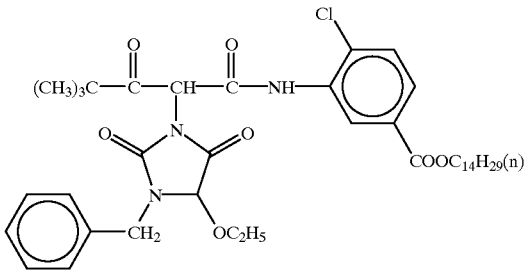

(ExM) Magenta Coupler
40:40:20 (by mole) mixture of

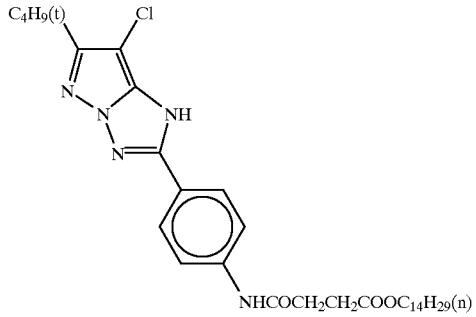

and

-continued
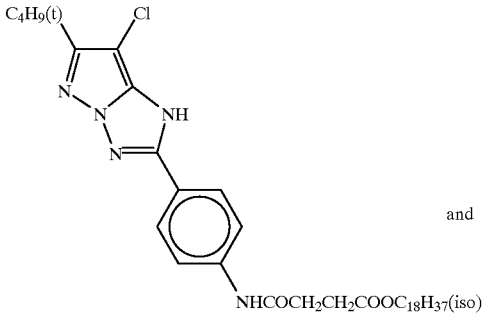
and
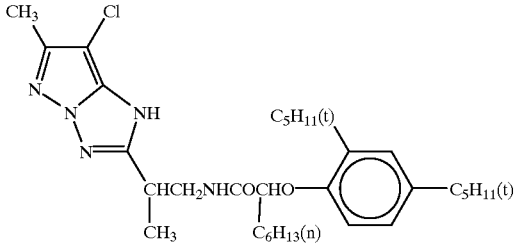
(ExC-1) Cyan Coupler
(ExC-2) Cyan Coupler
50:25:25 (by mole) mixture of
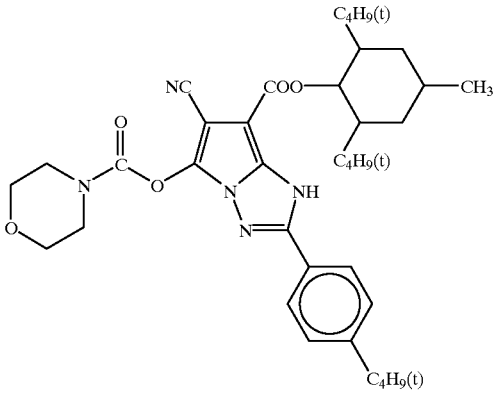
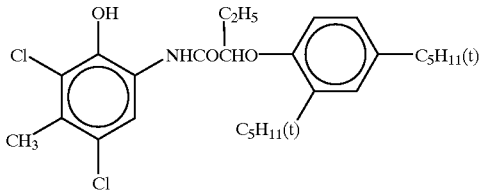
and
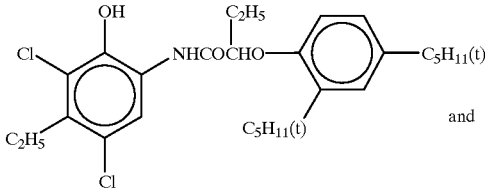
and
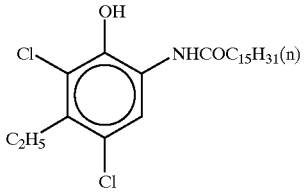
(Cpd-1) Color Image Stabilizer
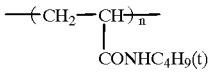
number average molecular weight:
60,000
(Cpd-2) Color Image Stabilizer
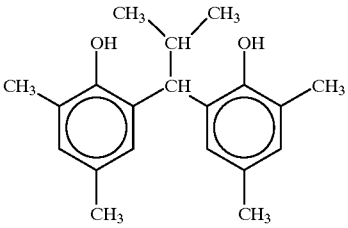
(Cpd-3) Color Image Stabilizer
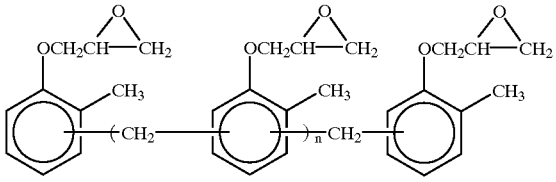
n = 7–8 (on average)
(Cpd-4) Color Stain Inhibitor
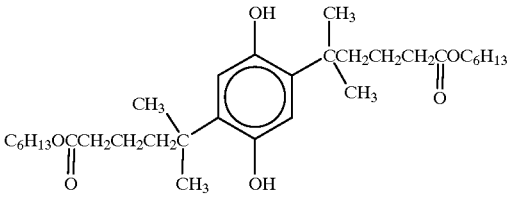

-continued
(Cpd-5) Color Stain Inhibiting Aid
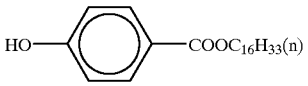
(Cpd-7) Color Stain Inhibitor
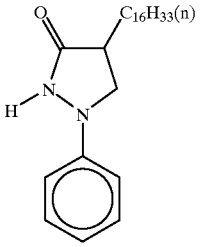
(Cpd-8) Color Image Stabilizer
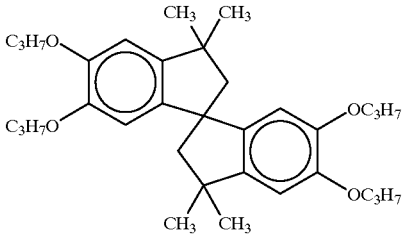
(Cpd-9) Color Image Stabilizer
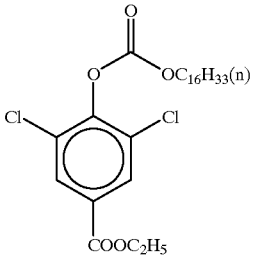
(Cpd-10) Color Image Stabilizer
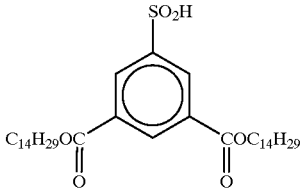
(Cpd-11) Dye
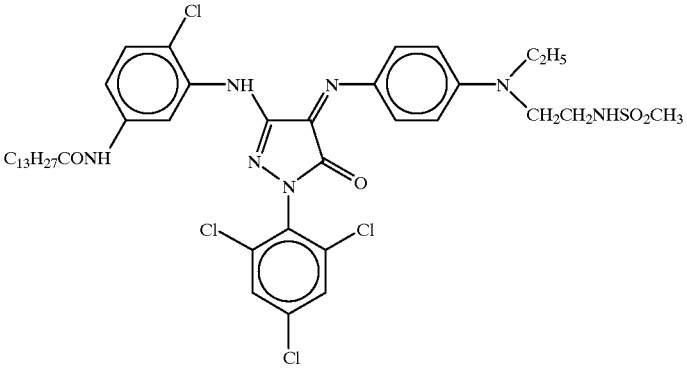
(Cpd-13) Surfactant
7:3 (by mole) mixture of
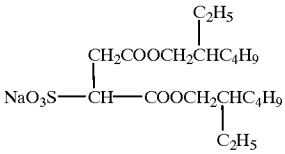
and
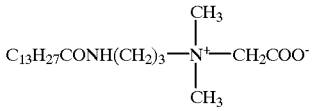
(Cpd-15) Color Image Stabilizer
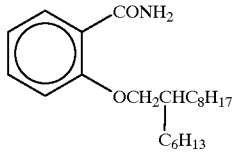

-continued (Cpd-18) Color Image Stabilizer

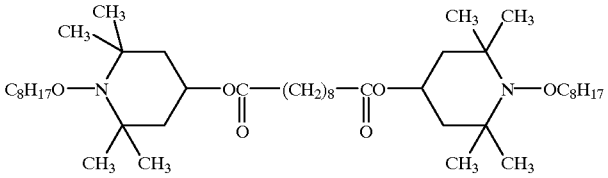

(Cpd-19) Color Image Stabilizer

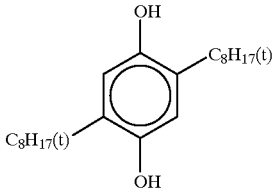

(UV-1) Ultraviolet Absorbent

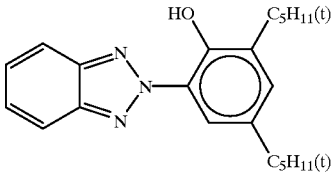

(UV-2) Ultraviolet Absorbent

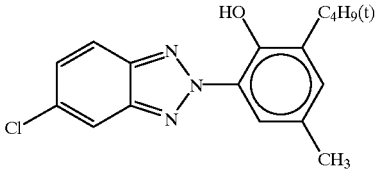

(UV-3) Ultraviolet Absorbent

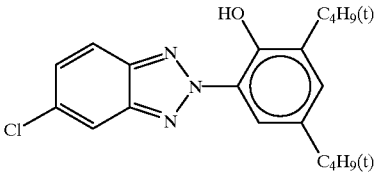

(UV-4) Ultraviolet Absorbent

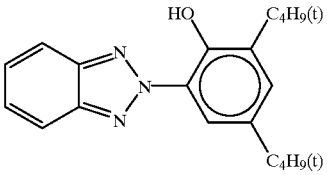

(UV-6) Ultraviolet Absorbent

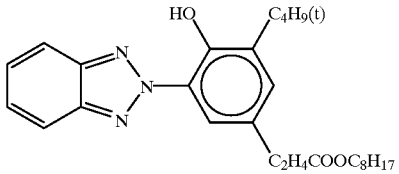

(UV-7) Ultraviolet Absorbent

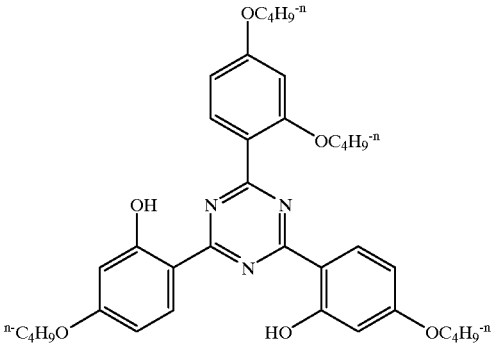

(Solv-1)

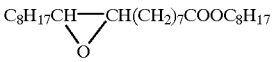

UV-A = 4:2:2:3 (by weight) mixture of UV-1, UV-2, UV-3 and UV-4
UV-C = 1:1:1:2 (by weight) mixture of UV-2, UV-3, UV-6 and UV-7

(Solv-3)

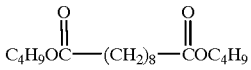

(Solv-4)

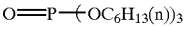

(Solv-5)

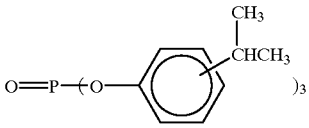

Coated Samples D to L were prepared using the emulsions shown in Table 1, respectively, in the blue-sensitive layer of the photosensitive material, the constituent layers of which have the foregoing compositions.

<Exposure>

Exposure of gradation of three color separation was performed with blue (B), green (G) and red (R) laser beams. At that time, laser output was corrected so as to obtain optimum improvements in each sample.

Exposure Apparatus

The three kinds of light sources used were as follows: the YAG solid laser device (oscillation wavelength; 946 nm) utilizing semiconductor laser GaAlAs (oscillaltion wavelength; 808.5 nm) as excitation light source, wherein the beams generated were subjected to the wavelength conversion using SHG crystal of $LiNbO_3$ having an inverted domain structure and therefrom the beam of 473 nm was picked out; the $YVO_4$ solid laser device (oscillation wavelength; 1064 nm) utilizing semiconductor laser GaAlAs (oscillaltion wavelength; 808.5 nm) as excitation light source, wherein the beams generated were subjected to the wavelength conversion using SHG crystal of $LiNbO_3$ having an inverted domain structure and therefrom the beam of 532 nm was picked out; and an AlGaInP laser device (oscillation wavelength; 680 nm; Type No. LN9R20, produced by Matsushita Electric Industrial Co., Ltd.). Blue, green and red laser beams each underwent intensity modulation by means of AOM, made to travel in the direction perpendicular to the scanning direction by means of a polygon mirror, and sequentially scanned a color photographic paper to perform the exposure. Therein, the semiconductor laser temperature-related fluctuations in the quantity of light was controlled by using a Peltier element to keep the temperature constant. The scanning exposure thus performed was 600 dpi, and the B, G and R laser beams had the same beam diameter of 65 $\mu$m, measured with a light beam diameter measurement apparatus 1180GP (a product of Beam Scan Inc. (USA)). Additionally, all the laser beams used were circular beams, because the difference between the beam diameters in the main scan and the sub-scan directions was found to be within 1%.

<Photographic Processing; dry-to-dry time of 180 seconds>

The thus exposed Samples were each subjected to the processing using a CP45X system made by Fuji Photo Film Co., Ltd.

The reflection densities of the Samples colored by the processing were measured with a TCD-type densitometer made by Fuji Photo Film Co., Ltd. The sensitivity was represented by the exposure amount required for providing the colored density 1.0 higher than the fog density. With respect to the blue-sensitive layer, the sensitivities shown in Table 1 are relative values, with the Coated Sample D being taken as 100.

<Processing Stability Test>

In order to examine the stability of Samples, the processing was carried out using the same CP45X system as mentioned above, except that the bleach-fixing solution P2 was mixed in the developer P1 in the amount of 0.5 ml per liter of P1. The processing stability is defined as the relative value of the sensitivity in the case of development with the P2-mixed developer to the sensitivity in the case of development with the P2-free developer, and the values determined are shown in Table 1. The sensitivities therein are those measured as the exposure amounts required for providing the density of fog +1.5.

As is apparent from the results of Table 1, every sample containing the emulsion according to the invention had high sensitivity, low fog and high processing stability. Although the processing stability was generally especially low in the emulsions comprising small-size grains, the present invention markedly achieved its effect upon the processing stability in the cases of small-size emulsion grains; as a result, the processing stability was greatly improved. Further, the effect of the present invention was promoted by the use of iodide and bromide in combination with chloride.

Although the present effects were remarkable even in the case of {100} tabular grains, the present invention achieved more remarkable effects in the case of {111} tabular grains.

TABLE 1

| Coated Sample | Grains | Equivalent Circle Diameter Variation Coefficient | Thickness Variation Coefficient | Composition Main Planes | Blue Exposure Fog | Blue Exposure Sensitivity | Processing Stability | |
|---|---|---|---|---|---|---|---|---|
| D | D | 1.32 $\mu$m 24.0% | 0.127 $\mu$m 30.6% | AgCl (111) | 0.03 | 100 | 0.08 | Comparison |
| E | E | 1.41 $\mu$m 22.0% | 0.116 $\mu$m 18.9% | AgCl (111) | 0.02 | 115 | 0.05 | invention |
| F | F | 1.46 $\mu$m 20.1% | 0.113 $\mu$m 14.9% | AgCl (111) | 0.02 | 131 | 0.03 | invention |
| G | G | 0.54 $\mu$m 24.3% | 0.111 $\mu$m 21.5% | AgCl (111) | 0.03 | 28 | 0.14 | comparison |
| H | H | 0.58 $\mu$m 19.5% | 0.102 $\mu$m 15.6% | AgCl (111) | 0.02 | 35 | 0.06 | invention |
| I | I | 0.58 $\mu$m 21.5% | 0.102 $\mu$m 15.6% | AgClI (111) | 0.02 | 88 | 0.05 | invention |
| J | J | 0.60 $\mu$m 20.8% | 0.102 $\mu$m 16.3 % | AgClIBr (111) | 0.02 | 85 | 0.04 | invention |
| K | K | 0.68 $\mu$m 20.4% | 0.120 $\mu$m 33.4 % | AgCl (100) | 0.04 | 78 | 0.14 | comparison |
| L | L | 0.66 $\mu$m 16.7% | 0.11 $\mu$m 14.9 % | AgCl (100) | 0.03 | 80 | 0.07 | invention |

EXAMPLE 2

Experiment 15: Use of monodisperse grains in the lowest layer

Samples were prepared in the same manner as in Experiment 14, except that the first layer and the fifth layer in each of the coated Samples G to J were replaced with each other, and referred to as Samples RG to RJ respectively. These samples underwent the same tests as in Experiment 14. The results obtained are shown in Table 2.

TABLE 2

| Coated Sample | Grains | Equivalent Circle Diameter Variation Coefficient | Thickness Variation Coefficient | Composition Main Planes | Blue Exposure Fog | Blue Exposure Sensitivity | Processing Stability | |
|---|---|---|---|---|---|---|---|---|
| RG | G | 0.54 μm 24.3% | 0.111 μm 21.5% | AgCl (111) | 0.03 | 100 | 0.09 | Comparison |
| RH | H | 0.58 μm 19.5% | 0.102 μm 15.6% | AgCl (111) | 0.02 | 121 | 0.06 | Invention |
| RI | I | 0.58 μm 21.5% | 0.104 μm 18.6% | AgClI (111) | 0.02 | 305 | 0.04 | Invention |
| RJ | J | 0.60 μm 20.8% | 0.102 μm 16.3% | AgClIBr (111) | 0.02 | 295 | 0.03 | Invention |

As is apparent from the results of Table 2, the processing stability was improved by the present invention, but the improved effect was small, as compared with the cases where the layer containing monodisperse grains was arranged as the uppermost layer.

EXAMPLE 3

Experiment 16: Photographic processing performed in dry-to-dry time of 60 seconds The same coated Samples G to J as prepared in Experiment 14 were each subjected to the following processing that was performed in the dry-to-dry time of 60 seconds. Additionally, the exposure of each Sample was carried out in the same manner as in Experiment 14.

| Processing step | Temperature | Time | Amount replenished* | Tank volume |
|---|---|---|---|---|
| Color development | 45° C. | 15 sec. | 35 ml | 2 liter |
| Bleach-fix | 40° C. | 15 sec. | 38 ml | 1 liter |
| Rinsing (1) | 40° C. | 10 sec. | — | 1 liter |
| Rinsing (2) | 40° C. | 10 sec. | — | 1 liter |
| Rinsing (3) | 40° C. | 10 sec. | 90 ml | 1 liter |
| Drying | 80° C. | 10 sec. | — | — |

[The rinsing was conducted in 3-tank counter-current system from the rinsing tank (3) to the rinsing tank (1)]
*: per $m^2$ of photographic material In the above process, water of rinsing (3) tank was force fed to a reverse osmosis membrane, the penetrated water was charged to rinsing (3), tank, and concentrated water not passed the reverse osmosis membrane was fed back to rinsing (2) tank and used. For saving the crossover time, blades were installed connecting each rinsing tank and samples were passed therebetween. A spraying apparatus as disclosed in JP-A-8-314088 was installed in each step and a circulating processing solution was sprayed to samples at spraying rate per one tank of from 4 to 6 liters/minute.

The composition of each processing solution is described below.

| Color Developer: | Tank soln. | Replenisher |
|---|---|---|
| Water | 700 ml | 700 ml |
| Sodium triisopropylnaphthalene-(13) sulfonate | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |

-continued

| Color Developer: | Tank soln. | Replenisher |
|---|---|---|
| Triethanolamine | 12.0 g | 12.0 g |
| Potassium chloride | 15.8 g | — |
| Potassium bromide | 0.04 g | — |
| Potassium carbonate | 27.0 g | 27.0 g |
| Sodium sulfate | 0.1 g | 0.1 g |
| Disodium-N,N-bis(sulfonatoethyl)-hydroxylamine | 18.0 g | 18.0 g |
| N-Ethyl-N-(β-methanesulfonamido-ethyl)-3-methyl-4-aminoaniline sulfate | 8.0 g | 23.0 g |
| Sodium-bis(2,3-disulfonatoethyl-1,3,5-triazyl-6)-diaminostilbene-2,2'-disulfonate | 5.0 g | 6.0 g |
| Water to make | 1,000 ml | 1,000 ml |
| pH (25° C.) adjusted to | 10.35 | 12.80 |

The bleach-fixing solution was prepared by mixing the following two kinds of replenishers in the following amounts:

| Bleach-fixing solution | Tank solution | Amount replenished* |
|---|---|---|
| First replenisher | 260 ml | 18 ml |
| Second replenisher | 290 ml | 20 ml |
| Water to make | 1,000 ml | |
| pH (25° C.) adjusted to | 5.0 | |

The compositions of the first and second replenishers are as follows.

| First Replenisher: | |
|---|---|
| Water | 150 ml |
| Ethylenebisquanidine nitrate | 30 g |
| Ammonium sulfite monohydrate | 226 g |
| Ethylenediaminetetraacetic acid | 7.5 g |
| Brightening agent (*1) | 1.0 g |
| Ammonium bromide | 30 g |
| Ammonium thiosulfate (700 g/l) | 340 ml |
| Water to make | 1,000 ml |
| pH (25° C.) adjusted to | 5.82 |
| **Second Replenisher:** | |
| Water | 140 ml |
| Ethylenediaminetetraacetic acid | 11.0 g |

-continued

| | |
|---|---|
| Ammonium ethylenediaminetetra acetatoferrate(III) | 384 g |
| Acetaic acid (50%) | 230 ml |
| Water to make | 1,000 ml |
| pH (25° C.) adjusted to | 3.35 |

*1: Brightening agent of triazinylaminostilbene type, Hakkol FWA-SF (trade name, a product of Showa Kagaku k.k.)

Rinsing Solution:

Ion exchange water (in which calcium and magnesium ion concentrations were each 3 ppm or less).

The test results are shown in Table 3. The sensitivities shown in Table 3 are relative values, with the coated Sample G being taken as 100. In the rapid processing also, the present invention achieved remarkable effects.

TABLE 3

| Coated Sample | Grains | Equivalent Circle Diameter Variation Coefficient | Thickness Variation Coefficient | Composition Main Planes | Blue Exposure Fog | Blue Exposure Sensitivity | Processing Stability | |
|---|---|---|---|---|---|---|---|---|
| RG | G | 0.54 μm 24.3% | 0.111 μm 21.5% | AgCl (111) | 0.03 | 100 | 0.15 | Comparison |
| RH | H | 0.58 μm 19.5% | 0.102 μm 15.6% | AgCl (111) | 0.02 | 128 | 0.07 | Invention |
| RI | I | 0.58 μm 21.5% | 0.104 μm 18.6% | AgClI (111) | 0.02 | 320 | 0.05 | Invention |
| RJ | J | 0.60 μm 20.8% | 0.102 μm 16.3% | AgClIBr (111) | 0.02 | 313 | 0.04 | Invention |

EFFECT OF THE INVENTION

The photographic silver halide emulsions, the photographic materials comprising the emulsion and the processing method according to the invention enable the achievement of high sensitivity, low fog and excellent processing stability.

While the invention has been described in detail and with reference to specific embodiments thereof, it will be apparent to one skilled in the art that various changes and modifications can be made therein without departing from the spirit and scope thereof.

What is claimed is:

1. A photographic silver halide emulsion comprising tabular grains:

said tabular grains having a silver chloride content of at least 95 mole %, an aspect ratio of at least 2 and a distance between main planes of 0.13 μm or less;

wherein said tabular grains occupy at least 90%, based on the total projected area, of the total silver halide grains in said emulsion and have a variation coefficient of 20% or less in the distance between the main planes.

2. The silver halide emulsion as claimed in claim 1, wherein said tabular grains have an average equivalent circle diameter of 0.8 μm or less.

3. The silver halide emulsion as claimed in claim 1, wherein said tabular grains have a variation coefficient of 22% or less in the equivalent circle diameter.

4. The silver halide emulsion as claimed in claim 1, wherein said tabular grains comprise tabular grains having (111) faces as the main plane.

5. The silver halide emulsion as claimed in claim 1, wherein said tabular grains have a silver iodide content of from 0.2 to 0.6 mole % based on the silver.

6. The silver halide emulsion as claimed in claim 1, wherein said tabular grains have a silver bromide content of from 0.1 to 4 mole % based on the silver.

7. The silver halide emulsion as claimed in claim 1, wherein said tabular grains each comprise a core and a shell as the outermost layer and the silver iodide content in the shell is at least 2 mole %.

8. The silver halide emulsion as claimed in claim 1, wherein said tabular grains each contain a bromide-localized phase in which the difference between the bromide-localized phase and other phases in bromide concentration is at least 6 mole %.

9. The silver halide emulsion as claimed in claim 8, wherein said bromide-localized phase contains an iridium compound in a proportion of from $1\times10^{-8}$ to $1\times10^{-5}$ mole % based on the total silver in each grain.

10. A silver halide photographic material comprising a support having thereon at least two light-sensitive layers, wherein the light-sensitive layer arranged farthest from the support comprises a silver halide emulsion comprising tabular grains:

said tabular grains having a silver chloride content of at least 95 mole %, an aspect ratio of at least 2 and a distance between main planes of 0.13 μm or less; wherein said tabular grains occupy at least 90%, based on the total projected area, of the total silver halide grains in said emulsion and have a variation coefficient of 20% or less in the distance between the main planes.

11. A silver halide photographic material comprising a support having thereon at least one silver halide emulsion layer, wherein at least one of said emulsion layers comprises a silver halide emulsion comprising tabular grains:

said tabular grains having a silver chloride content of at least 95 mole %, an aspect ratio of at least 2 and a distance between main planes of 0.13 μm or less; wherein said tabular grains occupy at least 90%, based on the total projected area, of the total silver halide grains in said emulsion and have a variation coefficient of 20% or less in the distance between the main planes.

12. A method of development-processing a silver halide photographic material, wherein the photographic material processed is a silver halide photographic material comprising a support having thereon at least two light-sensitive layers, wherein the light-sensitive layer arranged farthest from the support comprises a silver halide emulsion comprising tabular grains:

said tabular grains having a silver chloride content of at least 95 mole %, an aspect ratio of at least 2 and a distance between main planes of 0.13 μm or less; wherein said tabular grains occupy at least 90%, based on the total projected area, of the total silver halide grains in said emulsion and have a variation coefficient of 20% or less in the distance between the main planes, and the dry-to-dry processing time is 60 sec. or less.

13. A method of development-processing a silver halide photographic material, wherein the photographic material processed is a silver halide photographic material comprising a support having thereon at least one silver halide emulsion layer, wherein at least one of said emulsion layers comprises a silver halide emulsion comprising tabular grains:

said tabular grains having a silver chloride content of at least 95 mole %, an aspect ratio of at least 2 and a distance between main planes of 0.13 $\mu$m or less; wherein said tabular grains occupy at least 90%, based on the total projected area, of the total silver halide grains in said emulsion and have a variation coefficient of 20% or less in the distance between the main planes, and the dry-to-dry processing time is 60 sec. or less.

* * * * *